US011551647B2

(12) United States Patent
Hoshino et al.

(10) Patent No.: US 11,551,647 B2
(45) Date of Patent: Jan. 10, 2023

(54) KEYBOARD INSTRUMENT

(71) Applicant: CASIO COMPUTER CO., LTD., Tokyo (JP)

(72) Inventors: Akihisa Hoshino, Fussa (JP); Atsushi Oshiro, Fussa (JP); Hirokatsu Katoh, Kawasaki (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/174,451

(22) PCT Filed: Jul. 13, 2020

(86) PCT No.: PCT/JP2020/027179
§ 371 (c)(1),
(2) Date: Feb. 12, 2021

(87) PCT Pub. No.: WO2021/010362
PCT Pub. Date: Jan. 21, 2021

(65) Prior Publication Data

US 2022/0130352 A1 Apr. 28, 2022

(30) Foreign Application Priority Data

Jul. 16, 2019 (JP) ..... JP2019-131329

(51) Int. Cl.
*G10C 3/02* (2006.01)
*G10C 3/12* (2006.01)
*G10H 1/32* (2006.01)

(52) U.S. Cl.
CPC ..... *G10C 3/02* (2013.01); *G10C 3/12* (2013.01); *G10H 1/32* (2013.01)

(58) Field of Classification Search
CPC ..... G10C 3/02; G10C 3/12
See application file for complete search history.

(56) References Cited

U.S. PATENT DOCUMENTS 7,544,877 B2 * 6/2009 Saito ..... G10C 3/12 84/453
8,338,688 B2 12/2012 Shinjo
8,785,756 B2 * 7/2014 Murozono ..... G10C 3/12 84/453

(Continued)

FOREIGN PATENT DOCUMENTS

CN 207009071 U 2/2018
CN 208422391 U 1/2019

(Continued)

OTHER PUBLICATIONS

International Search Report (ISR) and Written Opinion (and English language translation thereof) dated Sep. 29, 2020 issued in International Application No. PCT/JP2020/027179.

(Continued)

*Primary Examiner* — Robert W Horn
(74) *Attorney, Agent, or Firm* — Holtz, Holtz & Volek PC

(57) ABSTRACT

A keyboard instrument includes a keyboard and an instrument case having a through hole penetrating therethrough from a top surface side to a bottom surface side and a positioning part configured to decide on a position of a music stand when a part of the music stand is disposed in the through hole.

20 Claims, 13 Drawing Sheets

(56) References Cited

U.S. PATENT DOCUMENTS

| | | | | |
|---|---|---|---|---|
| 10,636,393 | B2 * | 4/2020 | Yamashita | G10C 1/00 |
| 2007/0012162 | A1 | 1/2007 | Saito | |
| 2018/0350335 | A1 * | 12/2018 | Hoshino | G10G 5/005 |
| 2022/0093069 | A1 * | 3/2022 | Fukushima | G10G 7/00 |
| 2022/0130352 | A1 * | 4/2022 | Hoshino | G10C 3/12 |

FOREIGN PATENT DOCUMENTS

| | | | | |
|---|---|---|---|---|
| JP | S56120592 | U | | 9/1981 |
| JP | S63162398 | U | | 10/1988 |
| JP | 2001092458 | A | | 4/2001 |
| JP | 2004226636 | A | | 8/2004 |
| JP | 2005284146 | A | * | 10/2005 |
| JP | 2005284146 | A | | 10/2005 |
| JP | 2006243585 | A | | 9/2006 |
| JP | 2006251716 | A | | 9/2006 |
| JP | 2008040047 | A | | 2/2008 |
| JP | 4241649 | B2 | | 1/2009 |
| JP | 2009229860 | A | | 10/2009 |
| JP | 2011164423 | A | | 8/2011 |
| JP | 5548967 | B2 | | 5/2014 |
| WO | 2021010362 | | | 1/2021 |

OTHER PUBLICATIONS

Brazilian Unfavorable Technical Opinion noticed in the Brazilian Industrial Property Journal No. 2645 on Sep. 14, 2021, (and English translation thereof) issued in counterpart Brazilian Application No. BR112021002733-5.

Indian First Examination Report dated Feb. 22, 2022, (and English translation thereof) issued in counterpart Indian Application No. 202117006504.

* cited by examiner

KEYBOARD INSTRUMENT

CROSS-REFERENCE TO RELATED APPLICATION

This application is based upon and claims the benefit of priority (JP2019-131329, Jul. 16, 2019) under 35 USC 119 of PCT Application No. PCT/JP2020/027179 filed on Jul. 13, 2020, the entire disclosure of which, including the specification, claims, drawings, and abstract, is incorporated herein by reference in its entirety.

BACKGROUND OF THE INVENTION

Field of the Invention

The present invention relates to a keyboard instrument.

Description of the Related Art

Conventionally, there are provided keyboard instruments that include a detachable music stand. For example, Patent Literature JP-A-2009-229860 discloses a keyboard instrument that includes a music stand device in which a musical score support plate is detachably erected on a musical score rest section.

SUMMARY OF THE INVENTION

When the music stand gets loosened as keys are pressed down, there is caused a problem in playing the keyboard instrument properly. On the other hand, the music stand is desired to be easily attached to and detached from the keyboard instrument.

An object of the invention is to provide a keyboard instrument which can easily be carried and to which a music stand can easily be attached without looseness.

According to the present invention, there is provided a keyboard instrument including a keyboard and an instrument case having a through hole that penetrates the instrument case from a top surface side to a bottom surface side thereof and a positioning part configured to decide on a position of a music stand when apart of the music stand is disposed in the through hole.

With the present invention, there can be provided the keyboard instrument which can easily be carried and to which the music stand can easily be attached without looseness.

BRIEF DESCRIPTION OF THE DRAWINGS

FIG. 10A shows sectional views, corresponding to a sectional view taken along a line XIa-XIa at a center in a left-right direction of the keyboard instrument in FIG. 1, which show how to attach the music stand to the keyboard instrument according to the embodiment of the present invention and in which FIG. 10A shows a state before the music stand is attached.

FIG. 10B shows sectional views, corresponding to a sectional view taken along a line XIa-XIa at a center in a left-right direction of the keyboard instrument in FIG. 1, which show how to attach the music stand to the keyboard instrument according to the embodiment of the present invention and in which FIG. 10B shows a state in which an insertion section of the music stand is inserted into a through hole.

FIG. 11A shows sectional views showing a state in which the music stand has been attached to the keyboard instrument according to the embodiment of the present invention in which FIG. 11A is a sectional view taken along the line XIa-XIa at the center in the left-right direction of the keyboard instrument in FIG. 1.

FIG. 11B shows sectional views showing a state in which the music stand has been attached to the keyboard instrument according to the embodiment of the present invention in which FIG. 11B is a sectional view taken along a line XIb-XIb in a position deviating from the center in the left-right direction of the keyboard instrument in FIG. 1.

FIG. 12A shows sectional views, corresponding to a sectional view taken along the line XIa-XIa at the center in the left-right direction of the keyboard instrument in FIG. 1, which show how to detach the music stand attached to the keyboard instrument according to the embodiment of the present invention and in which FIG. 12A shows a state in which the music stand is tilted to the front.

FIG. 12B shows sectional views, corresponding to a sectional view taken along the line XIa-XIa at the center in the left-right direction of the keyboard instrument in FIG. 1, which show how to detach the music stand attached to the keyboard instrument according to the embodiment of the present invention and in which FIG. 12B shows a state in which the music stand is pulled out.

DETAILED DESCRIPTION OF THE PREFERRED EMBODIMENT

Figure 1:
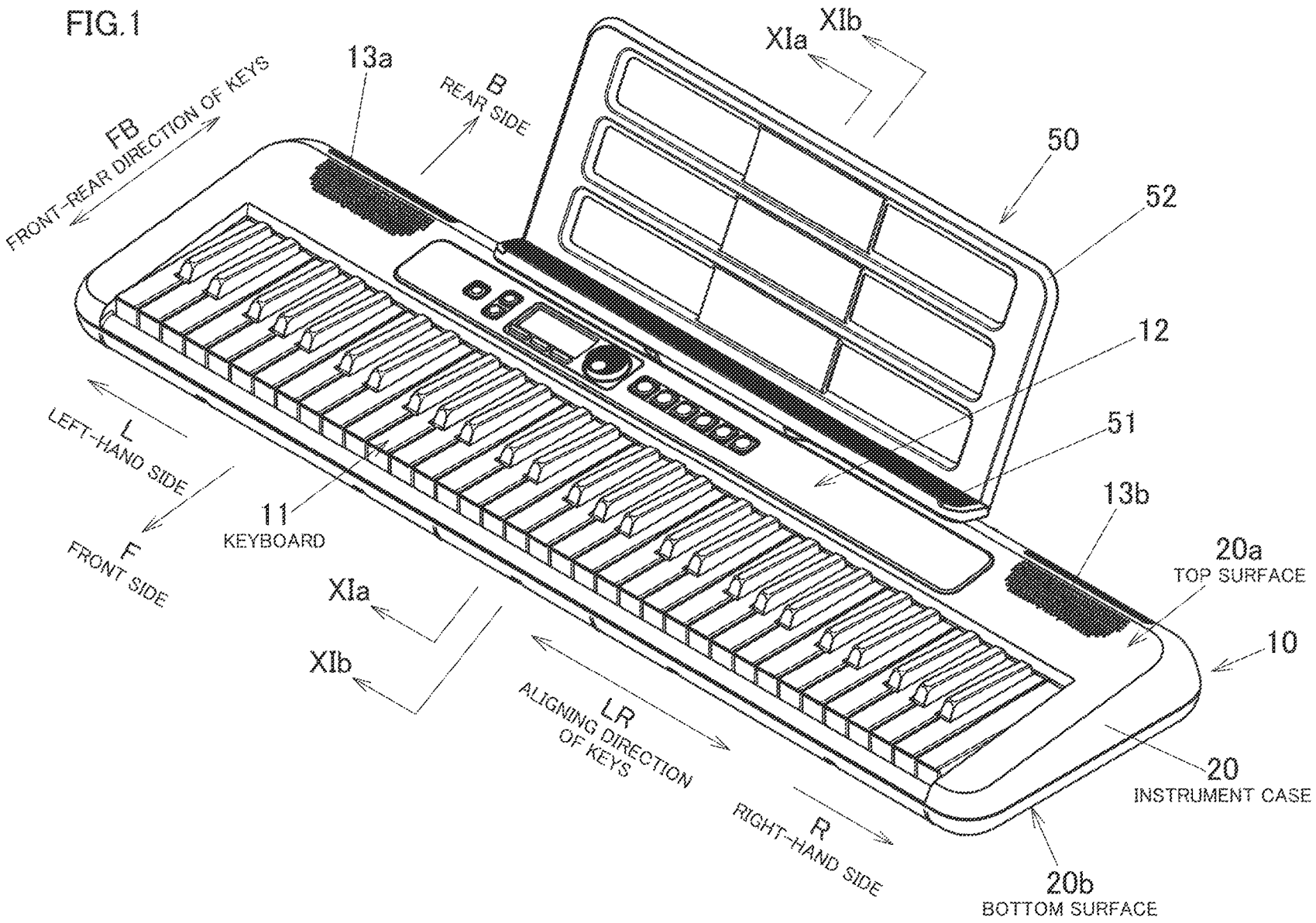
FIG. 1 is a perspective view of a keyboard instrument and a music stand attached to the keyboard instrument according to an embodiment of the invention, as seen from a front.
Figure 2:
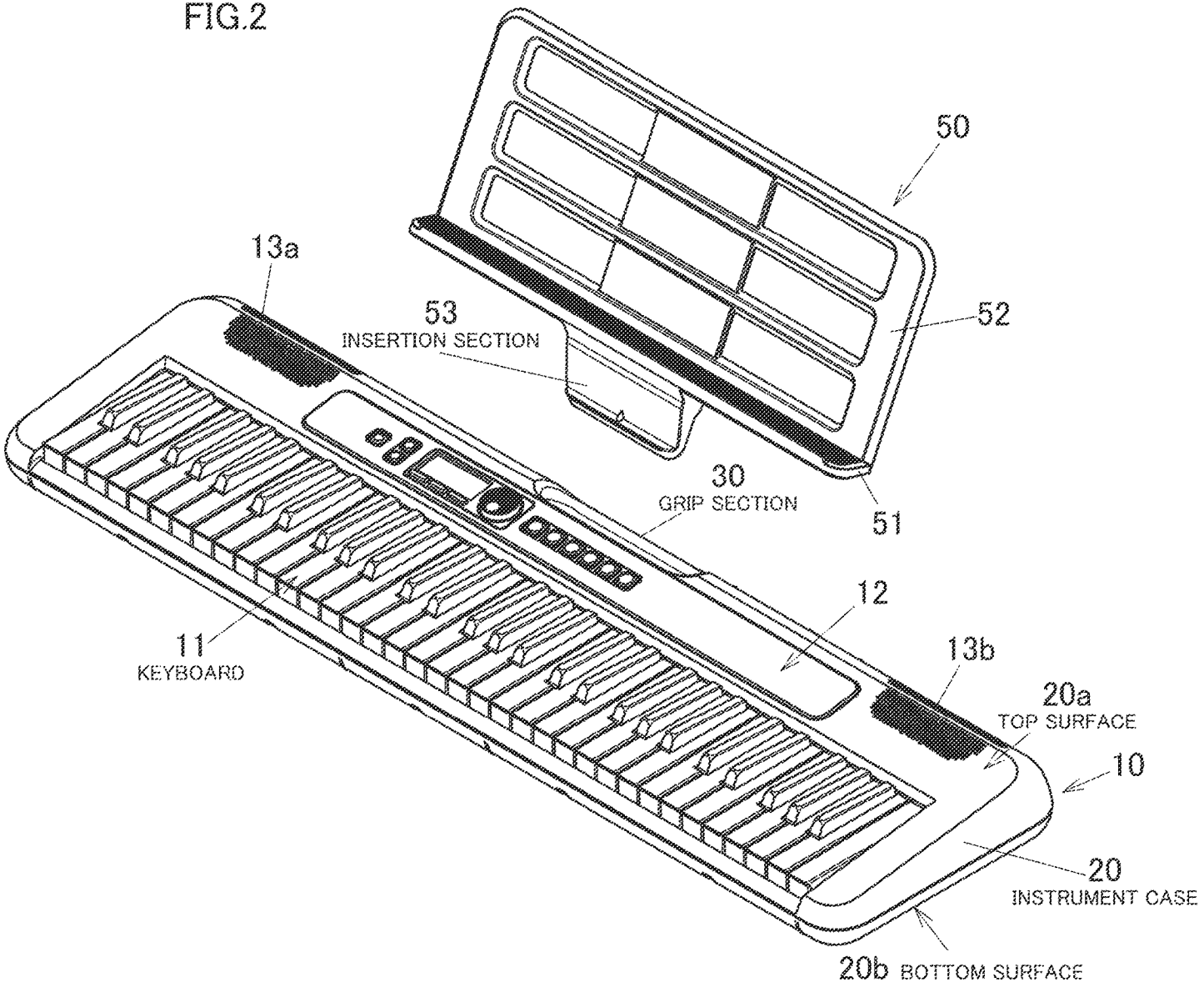
FIG. 2 is an exploded perspective view of the keyboard instrument and the music stand according to the invention, as seen from the front.

Hereinafter, an embodiment of the present invention will be described based on drawings. A keyboard instrument 10 and a music stand 50 are shown in FIGS. 1 and 2. Although it will be described in detail later on, the music stand 50 can freely be attached to and detached from the keyboard instrument 10. The keyboard instrument 10 is configured as an electronic piano or an electronic keyboard and includes a keyboard 11 and an instrument case 20. In the following description, a front of keys of the keyboard 11 in a front-rear direction FB thereof is referred to as a front side F, and a rear of the keys in the front-rear direction FB is referred to as a rear side B, while with a spectator facing the keyboard 11, a left of the keyboard 11 is referred to as a left-hand side L, and a right thereof is referred to as a right-hand side. An aligning direction LR of the keys of the keyboard 11 is referred to as a left-right direction. The instrument case 20 has a substantially rectangular plate-like shape with its longitudinal direction oriented in the left-right direction and includes an upper case and a lower case which are divided, and a circuit board, a battery constituting a power source, and the like are accommodated in the instrument case 20.

Figure 3:
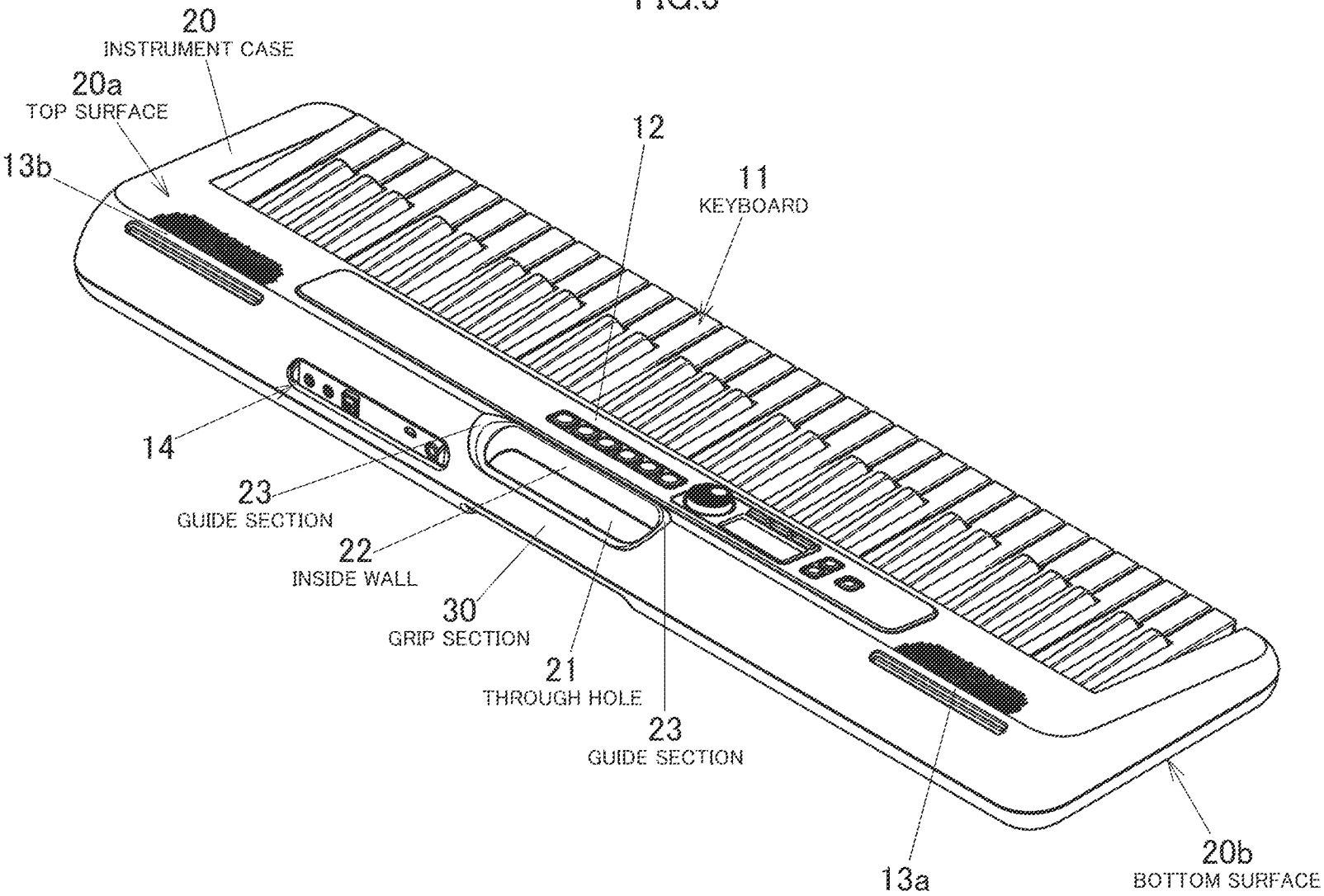
FIG. 3 is a perspective view of the keyboard instrument according to the embodiment of the present invention, as seen from a rear.

The keyboard instrument 10 includes a control section 12, where various types of settings or the like can be performed, on an upper surface of a rear of the instrument case 20 which constitutes a rear side B of the keyboard 11. Speaker sections 13*a*, 13*b* are provided individually at a left-hand side and a right-hand side of the control section 12. Multiple holes are opened in the upper surface and a rear surface of the instrument case 20 at the speaker sections 13*a*, 13*b*, and speakers, not shown, are provided in interior portions of the instrument case 20 that correspond to the speaker sections 13*a*, 13*b*. Additionally, as shown in FIG. 3, an input section 14, where various types of plugs can be connected, is provided on a back of the instrument case 20.

As shown in FIGS. 3 to 7, the instrument case 20 includes a grip section 30 at a rear side of a substantially central portion of the instrument case 20 in the left-right direction. The grip section 30 includes a part of an inside wall 22 of a through hole 21 that penetrates the instrument case 20 from a top surface 20*a* (an upper side) to a bottom surface 20*b* (a lower side) thereof. In the present embodiment, the grip portion 30 includes an inside wall 22 on a rear side B of the through hole 21. The through hole 21 has a long shape that is long in the left-right direction. The grip section 30 follows the through hole 21 and is formed substantially into a rod shape, and a rear surface of the instrument case 20, which includes a rear surface of the grip section 30, continues into the shape of a straight line as seen from above.

The keyboard instrument 10 has guide sections 23 that are convexly curved on a circumference of the through hole 21 at a left end and a right end thereof on a top surface 20*a* side of the instrument case 20. On the other hand, the grip section 30 has a convexly curved upper surface portion 30*a* and lower surface portion 30*b*. The guide sections 23 are curved surfaces that continue to the upper surface portion 30*a* of the grip section 30. A curvature of the guide sections 23 is set smaller than a curvature of the upper surface portion 30*a* of the grip section 30.

Figure 4:
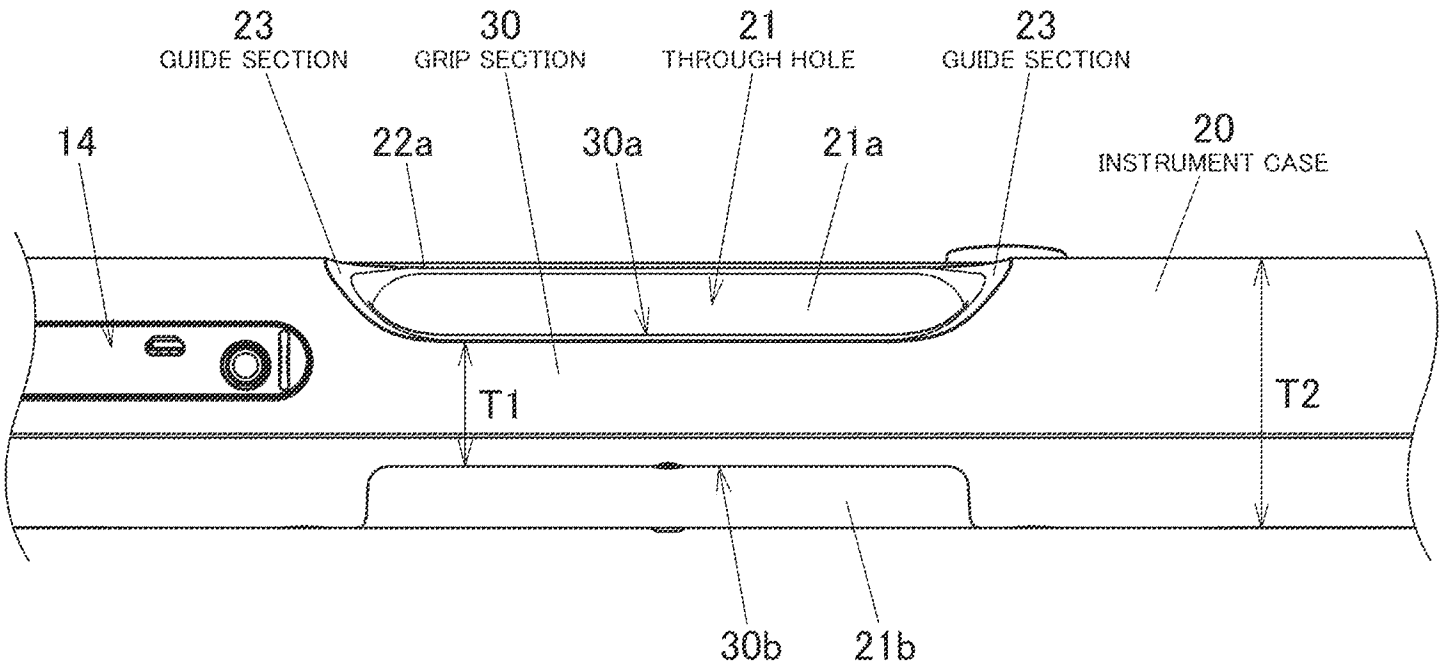
FIG. 4 is an enlarged back view of a grip section of the keyboard instrument according to the embodiment of the present invention, as seen from a rear surface side.
Figure 5:
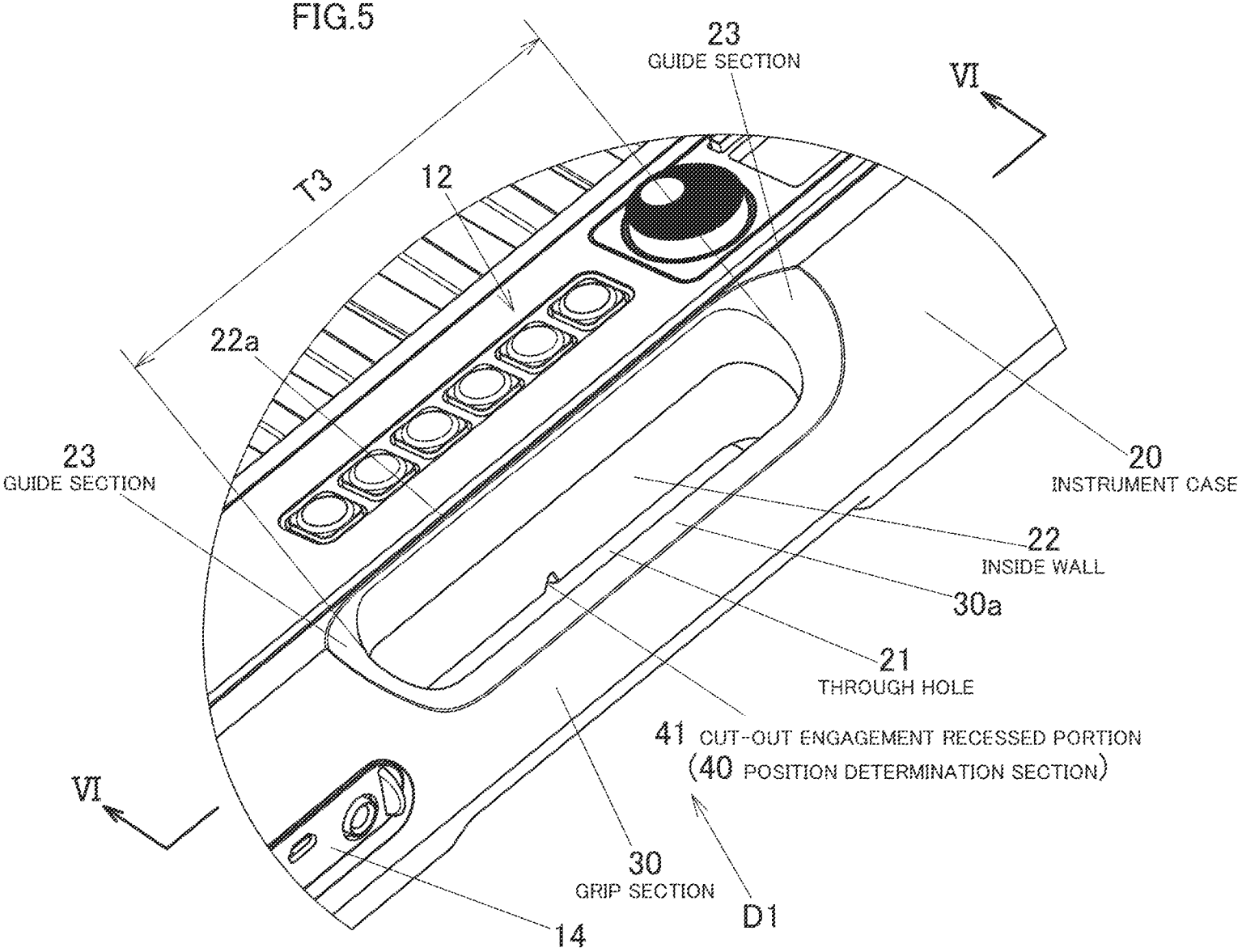
FIG. 5 is an enlarged perspective view of the grip section of the keyboard instrument according to the embodiment of the present invention, as seen from the rear.
Figure 6:
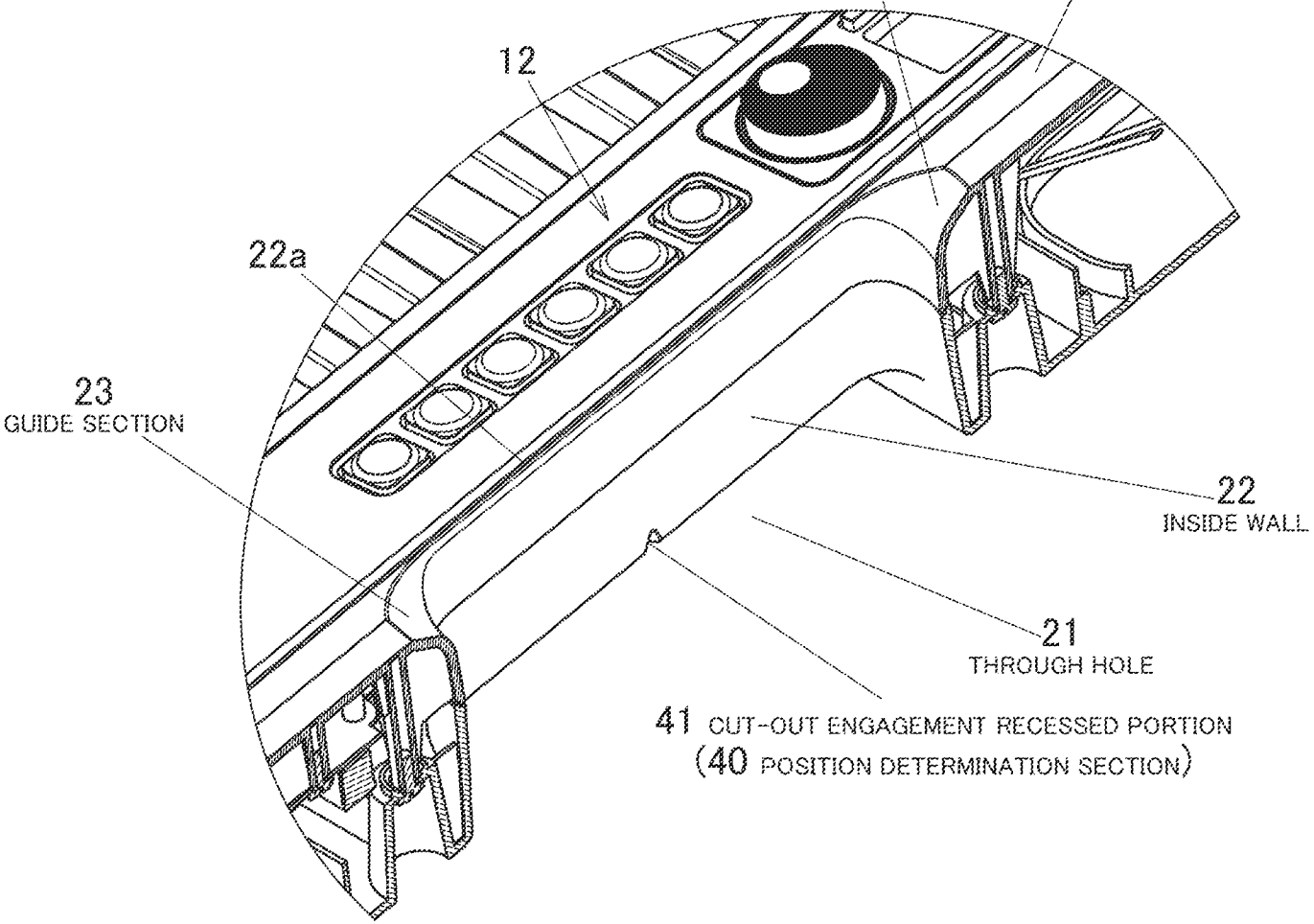
FIG. 6 is a sectional view, taken along a line VI-VI in FIG. 5, which shows the grip section of the keyboard instrument according to the embodiment of the present invention.

As shown in FIG. 4, the through hole 21 includes rear open portions 21*a*, 21*b*, which are opened to a rear surface side of the instrument case 20, on an upper side and a lower side of the through hole 21. Consequently, a dimension T1 of the grip section 30 in an up-down direction is smaller than a dimension T2 (a thickness) in the up-down direction of the instrument case 20 at a portion adjoining the grip section 30. This enables the grip section 30 to have a thickness that is so moderately thin to be gripped. In addition, the rear open portion 21*b* on the lower side allows a user to insert his or her hand into the through hole 21 from the rear open portion 21*b* in question to easily grip the grip section 30 even in such a state that the keyboard instrument 10 is placed flat on a desk or the like.

Additionally, multiple batteries for use as a power source are disposed near a center of the aligning direction LR of the keys of the keyboard 11 in the instrument case 20 in such a manner that the keyboard instrument 10 is balanced left and right uniformly so that the user (the player) can carry the keyboard instrument 10 well by gripping the grip section 30.

Figure 7:
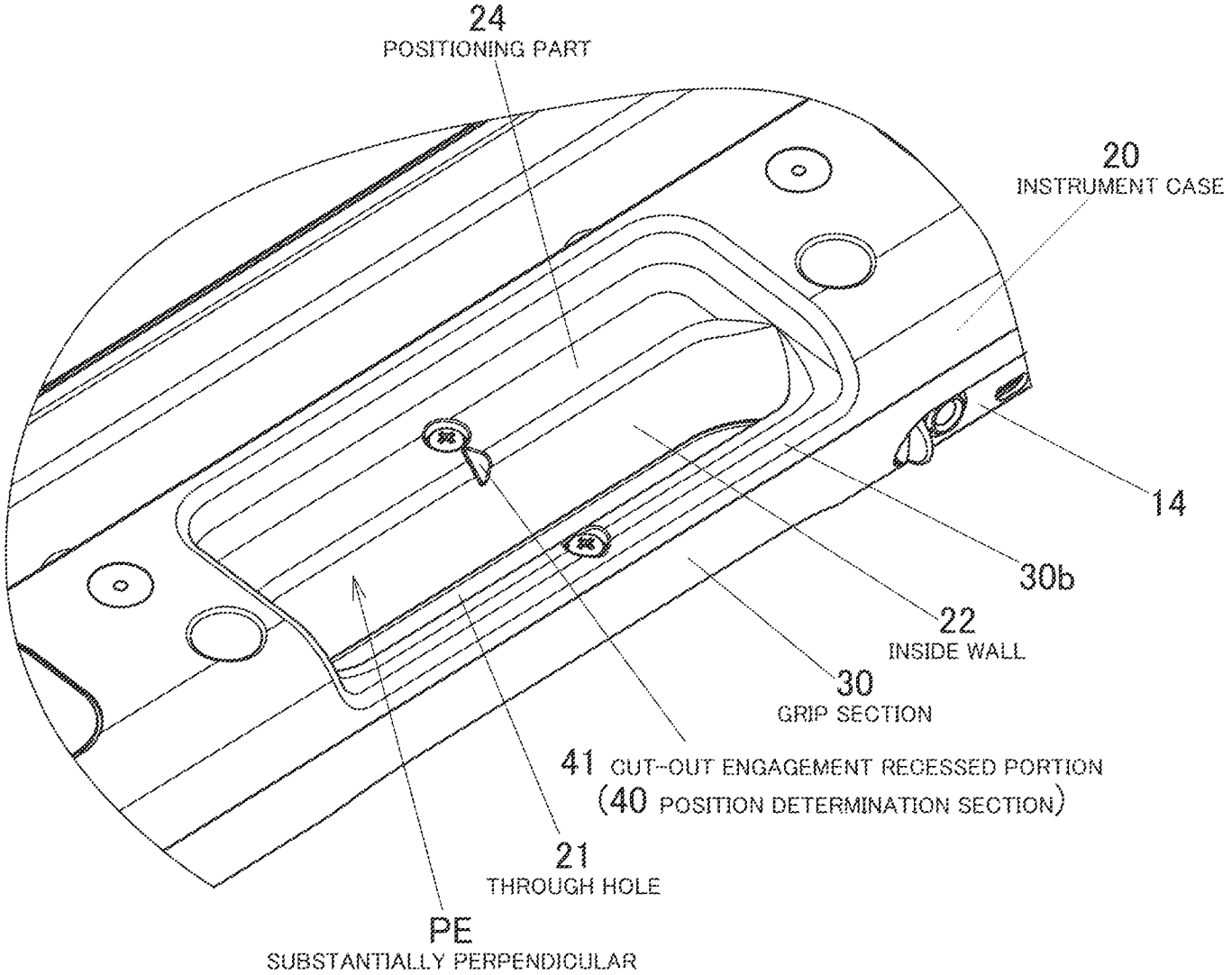
FIG. 7 is an enlarged perspective view of the grip section of the keyboard instrument according to the embodiment of the present invention, as seen in a direction D1 (from a bottom surface side) in FIG. 5.

The instrument case 20 has a positioning part 24 as shown in FIG. 7. Although it will be described in detail later on, the positioning part 24 is configured to decide on a position of a music stand 50 when apart of the music stand 50 is disposed in the through hole 21. Specifically speaking, the positioning part 24 is a downwardly oriented stepped surface disposed at a front side of the through hole 21 on a bottom surface 20*b* side of the instrument case 20. Consequently, an inside wall 22 on a keyboard 11 side (a front side F) of the through hole 21 and the positioning part 24 are disposed substantially perpendicularly (a reference sign PE) to each other.

Figure 8:
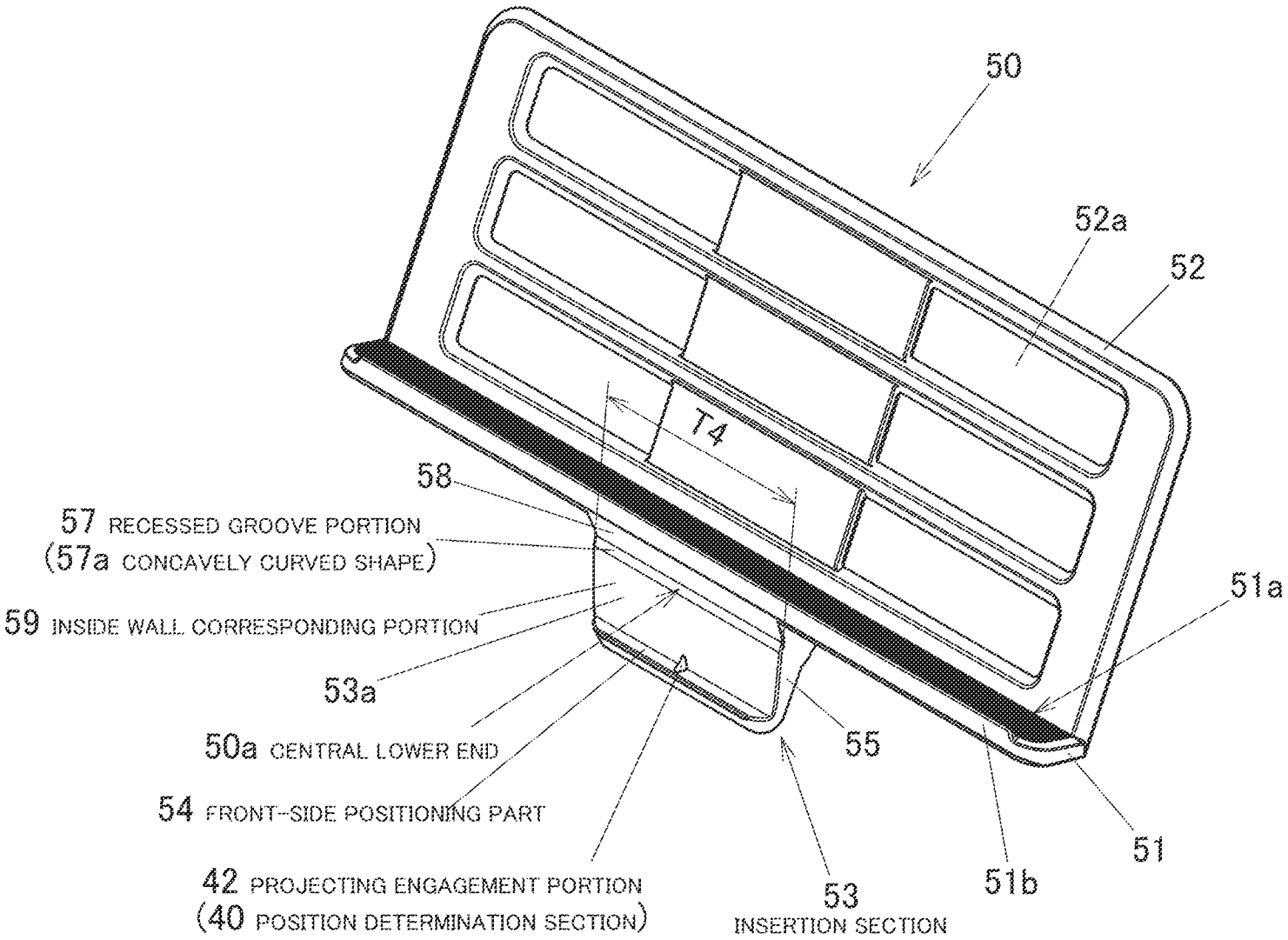
FIG. 8 is a perspective view of the music stand configured to be attached to the keyboard instrument according to the embodiment of the present invention, as seen from a front side.

The positioning part 24 has a position determination section 40 for determining a position where the music stand 50 is locked. The position determination section 40 includes a cut-out engagement recessed portion 41 positioned at a longitudinal center of an edge portion (a corner portion) on a through hole 21 side of the positioning part 24. Although it will be described later on, the keyboard instrument 10 includes a projecting engagement portion 42 on the music stand 50 in a position that corresponds to the position determination section 40 (refer to FIGS. 8, 11).

The music stand 50 includes a lateral plate 51, which is formed into a shape which is long in the left-right direction with a planar surface section oriented in the up-down direction, and aback plate 52, which extends upwards from a rear end edge of the lateral plate 51 and which has a longitudinal dimension that is substantially the same as a longitudinal dimension of the lateral plate 51 in the left-right direction. Aside wall is formed on each of the lateral plate 51 and the back plate 52 in such a manner as to follow an external shape or a contour thereof. The lateral plate 51 includes multiple grooves 51*a*, which extend in the left-right direction, and a projecting section 51*b*, which projects at a front end of the lateral plate 51 and which is long in the left-right direction . The back plate 52 includes rectangular hole sections 52*a*, which are opened in three locations on each of left- and right-hand sides of the back plate 52. In the music stand 50, musical scores are placed on the lateral plate 51 in such a manner as to lean against the back plate 52 for use.

The music stand 50 includes an insertion section 53, which projects from a central lower end 50*a* of the music stand 50. Specifically speaking, the insertion section 53 projects downwards from a lower surface of the lateral plate 51. The insertion section 53 includes a front plate 53*a* having a width in the left-right direction which is substantially the same as that of the through hole 21 (or narrower than that of the through hole 21). The front plate 53*a* includes a recessed groove portion 57, an inclined portion 58, and an inside wall corresponding portion 59, which will all be described later on.

The insertion section 53 has a tapered shape in which left and right edge portions are tapered minutely towards a distal end portion as seen from the front. In other words, the front plate 53*a* of the insertion section 53 is gradually and minutely contracted in width in the left-right direction towards a distal end thereof. Ribs 55 which are connected to left and right end portions of the front plate 53*a* are disposed in such a manner as to follow both the end portions of the front plate 53*a*. The inclined portion 58 of the front plate 53*a* is connected to the projecting section 51*b* of the lateral plate 51.

The insertion section 53 includes a front-side positioning part 54, whose lower distal end portion is bent at right angles towards the front so as to constitute a surface oriented upwards. The insertion section 53 includes the engagement projecting portion 42, which is provided substantially at a center of the front-side positioning part 54 in the left-right direction in such a manner as to project therefrom. The position determination section 40 includes the engagement projecting portion 42, and the engagement projecting portion 42 is configured so as to be brought into mating engagement with the engagement recessed portion 41 of the position determination section 40 (refer to FIG. 13).

The insertion section 53 includes the recessed groove portion 57, which is formed on a front surface side of the insertion section 53 (a front surface of the front plate 53*a*) in a position situated further upwards than the front-side positioning part 54. The recessed groove portion 57 constitutes a groove extending in the left-right direction, a bottom portion of which is formed into a concavely curved shape. The insertion section 53 includes the inclined portion 58, which connects with the recessed groove portion 57 at a upper end portion thereof to extend upwards therefrom and is inclined in such a manner as to protrude to the front at an upper end side thereof. Both the recessed groove portion 57 and the inclined portion 58 are situated further upwards than the front-side positioning part 54 and a rear-side positioning part 55*a*, which will be described later on.

Figure 9:
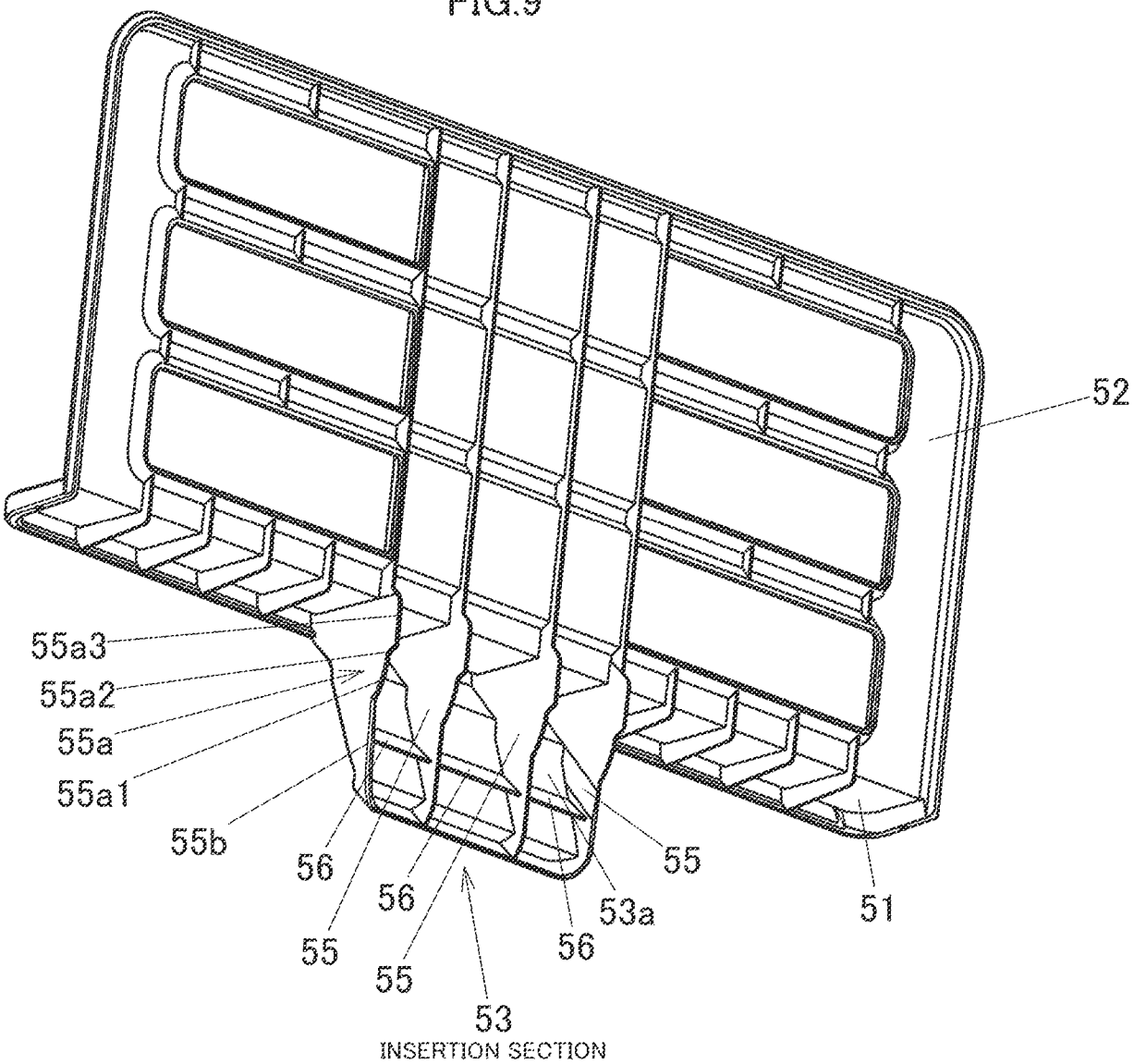
FIG. 9 is a perspective view of the music stand configured to be attached to the keyboard instrument according to the embodiment of the present invention, as seen from a rear side.

As shown in FIG. 9, the insertion section 53 includes four ribs 55 which are provided to extend towards the rear from the left and right end portions of the front plate 53*a* and a rear surface of the front plate 53*a*. When seen from a side, the rib 55 has a substantially triangular shape whose apex is directed downwards. The ribs 55 are connected to a lower surface of the front-side positioning part 54, which will be described later on, a rear surface of the front plate 53, and a lower surface of the lateral plate 51 to reinforce the insertion section 53. The insertion section 53 includes lateral ribs 56 that are disposed between the ribs 55 to reinforce the ribs 55.

The music stand 50 is decided on a position of the instrument case 20 stably within the through hole 21 of the instrument case 20 by the insertion section 53 that is constructed as described above.

Figure 11A:
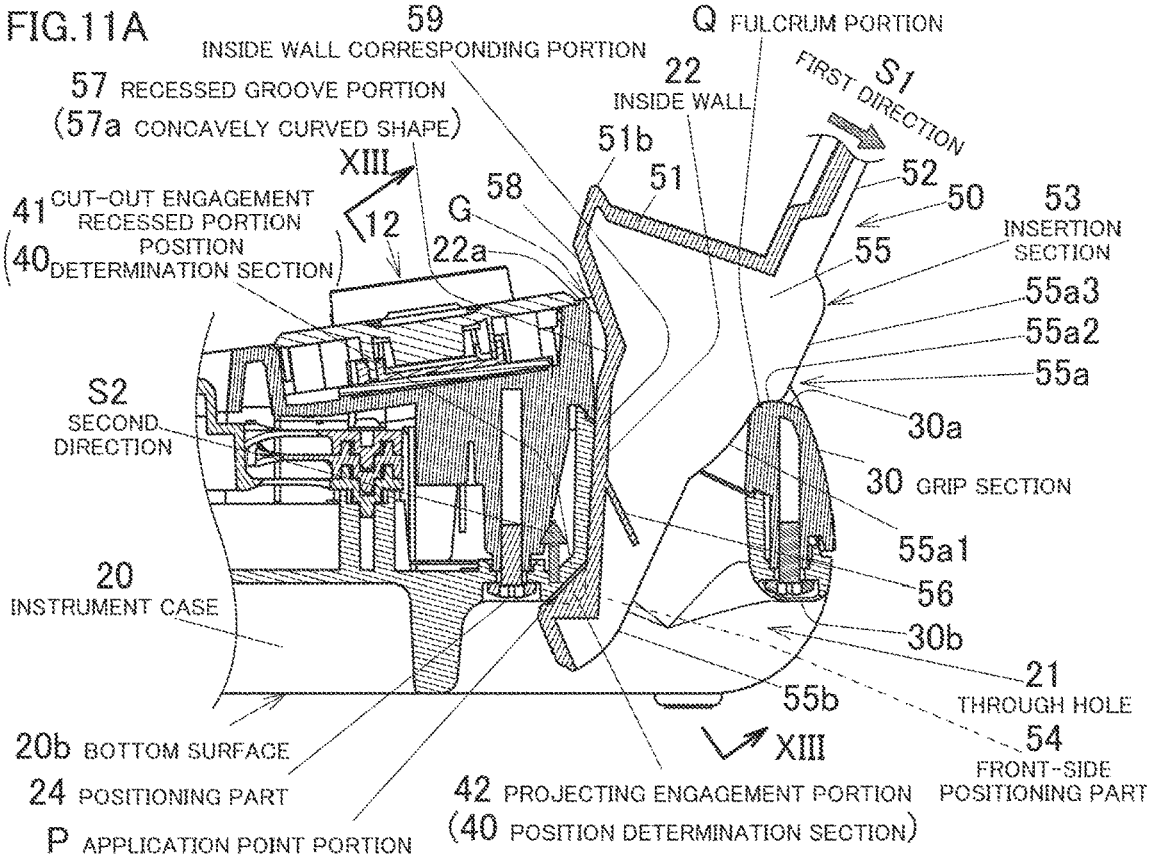
Figure 11B:
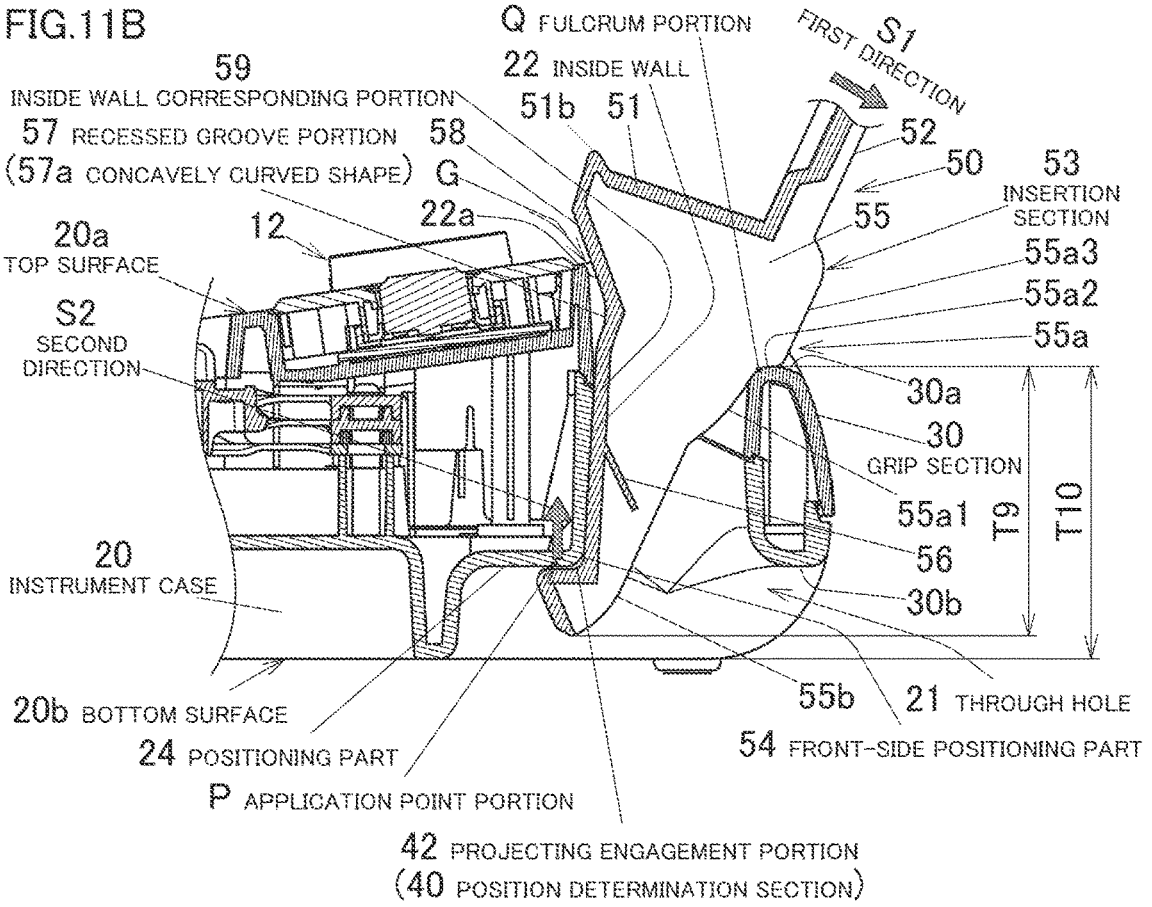

The insertion section 53 includes the rear-side positioning parts 55*a*. The rear-side positioning parts 55*a* are disposed individually at rear portions of the ribs 55. The rear-side positioning part 55*a* includes a projecting arc-shaped edge portion 55*a*1, which protrudes towards the rear into an arc shape from an edge line portion 55*b* which extends upwards from a distal end of the insertion section 53, a recessed arc-shaped edge portion 55*a*2, which is recessed into a recessed arc shape from the projecting arc-shaped edge portion 55*a*1, and a straight-line portion 55*a*3, which extends straight upwards from the recessed arc-shaped edge portion 55*a*2. As shown in FIGS. 11A, 11B, the rear-side positioning part 55*a* locks an upper surface portion 30*a*, which is an upper surface of the grip section 30, at a connecting portion between the projecting arc-shaped portion 55*a*1 and the recessed are-shaped portion 55*a*2. The instrument case 20 of the keyboard instrument 10 includes on a top surface 20*a* side of the grip section 30 a fulcrum portion Q, which functions as a fulcrum when the music stand 50 is decided on a position of the upper surface portion 30*a* of the grip section 30 of the instrument case 20 as a result of the insertion section 53, which constitutes a part of the music stand 50, being disposed in the through hole 21.

As shown in FIGS. 1 and 11, when the insertion section 53, which constitutes the part of the music stand 50, is inserted into the through hole 21 and a musical score is placed thereon in such a manner as to lean against the music stand 50, a force is generated in a direction (a first direction S1, refer to FIG. 11) in which the back plate 52 tilts to the rear. Then, a rotational force acting around the fulcrum portion Q is generated in the music stand 50. The positioning part 24 includes an application point portion P of a force that resists a force acting in a perpendicular direction (a second direction S2) when it comes into abutment with the front-side positioning part 54, which is configured as a substantially horizontal stepped portion.

The back plate 52, whose mass is greater than those of the lateral plate 51 and the insertion section 53, of the music stand 50 is positioned further rearwards than the fulcrum portion Q, and therefore, even in such a state that no musical score is placed to lean against the music stand 50, a slight magnitude of force is generated in the first direction S1 and the second direction S2. Consequently, the music stand 50 can be put in a steady state shown in FIGS. 11A, 11B even when no musical score is placed to lean against the music stand 50. However, the force acting on the application point portion P becomes great remarkably when a musical score is placed to lean against the music stand 50. Consequently, the music stand 50 is easily tilted around the fulcrum portion Q to the front in such a state that no musical score is placed to lean against the music stand 50.

The insertion section 53 of the music stand 50 includes the inside wall corresponding portion 59 and the front-side positioning part 54, which are both disposed substantially at right angles to a keyboard 11 side inside wall 22 and the positioning part 24, respectively. That is, the inside wall corresponding portion 59 is formed into a flat plane having a straight-line shape when seen from a side while extending from the recessed groove portion 57 to the front-side positioning part 54 and is connected with the front-side positioning part 54 at substantially right angles. When a force acting in the first direction S1 is generated as a result of a musical score being placed to lean against the music stand 50, the inside wall corresponding portion 59 is brought into abutment with the keyboard 11 side inside wall 22 of the through hole 21.

A width dimension T3 (refer to FIG. 5) in the left-right direction of the through hole 21 is greater than a maximum width dimension T4 (refer to FIG. 8) in the left-right direction of the insertion section 53. In addition, a dimension T5 (refer to FIG. 10A) in the front-rear direction of the through hole 21 is smaller than a dimension T6 from a point (for example, a deepest point of the recessed arc-shaped edge portion 55*a*2) constituting the fulcrum portion Q of the recessed arc-shaped edge portion 55*a*2 of the rear-side positioning part 55*a* to a predetermined position on the inclined portion 58. This restricts the insertion of the insertion section 53 into the through hole 21 in a halfway position, whereby a gap can be generated between the top surface 20*a* of the instrument case 20 and the lower surface of the lateral plate 51. That is, the predetermined position is a position where the insertion of the insertion section 53 into the through hole 21 is restricted. Additionally, a dimension T7 from the predetermined position to the front-side positioning part 54 is set substantially the same as a dimension T8 from a keyboard 11 side edge 22*a* of the through hole 21 on a top surface 20*a* side thereof to the positioning part 24 to such an extent that the positioning part 24 and the front-side positioning part 54 can be decided on a position together.

In addition, a dimension T9 from the fulcrum portion Q to the distal end of the insertion section 53 with the music stand 50 attached to the instrument case 20 is smaller than a dimension T10 from the fulcrum. portion Q to the bottom surface 20*b* of the instrument case 20. This prevents the distal end of the insertion section 53 from being brought into abutment with an upper surface of a desk, for example, even when the insertion section 53 of the music stand 50 is inserted into the through hole 21. Additionally, a dimension T11 from the lower surface portion 30*b* of the grip section 30 to the bottom. surface 20*b* and a dimension from the locking section 24 to the bottom surface 20*b* are set substantially the same, and hence, the dimension from the positioning part 24 to the bottom surface 20*b* is set at the dimension T11.

Figure 10A:
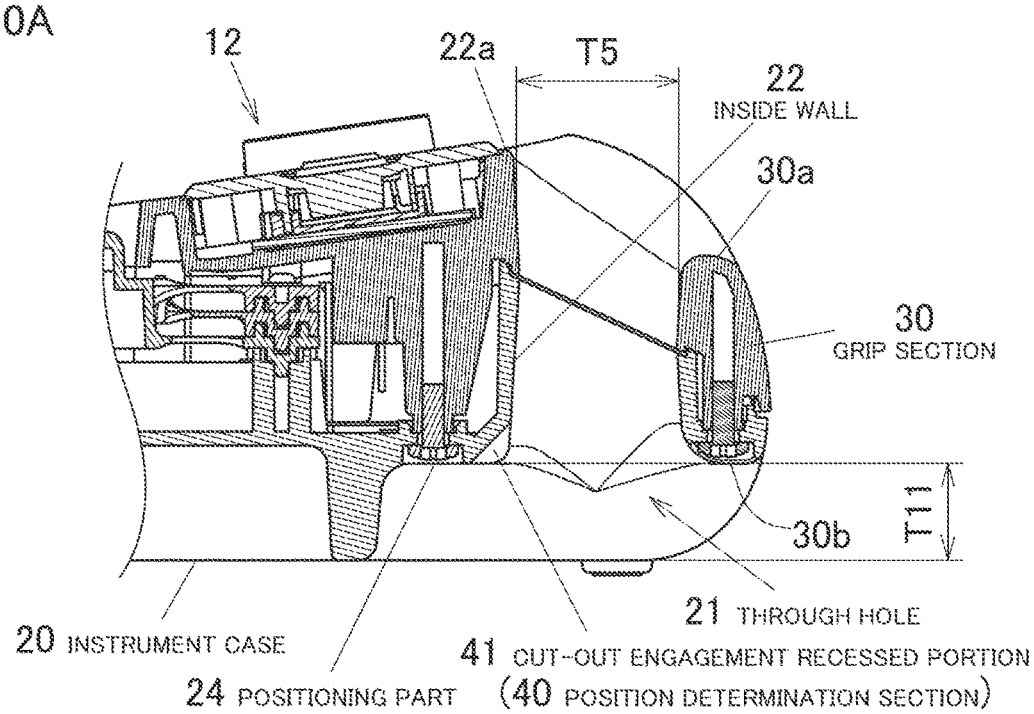
Figure 10B:
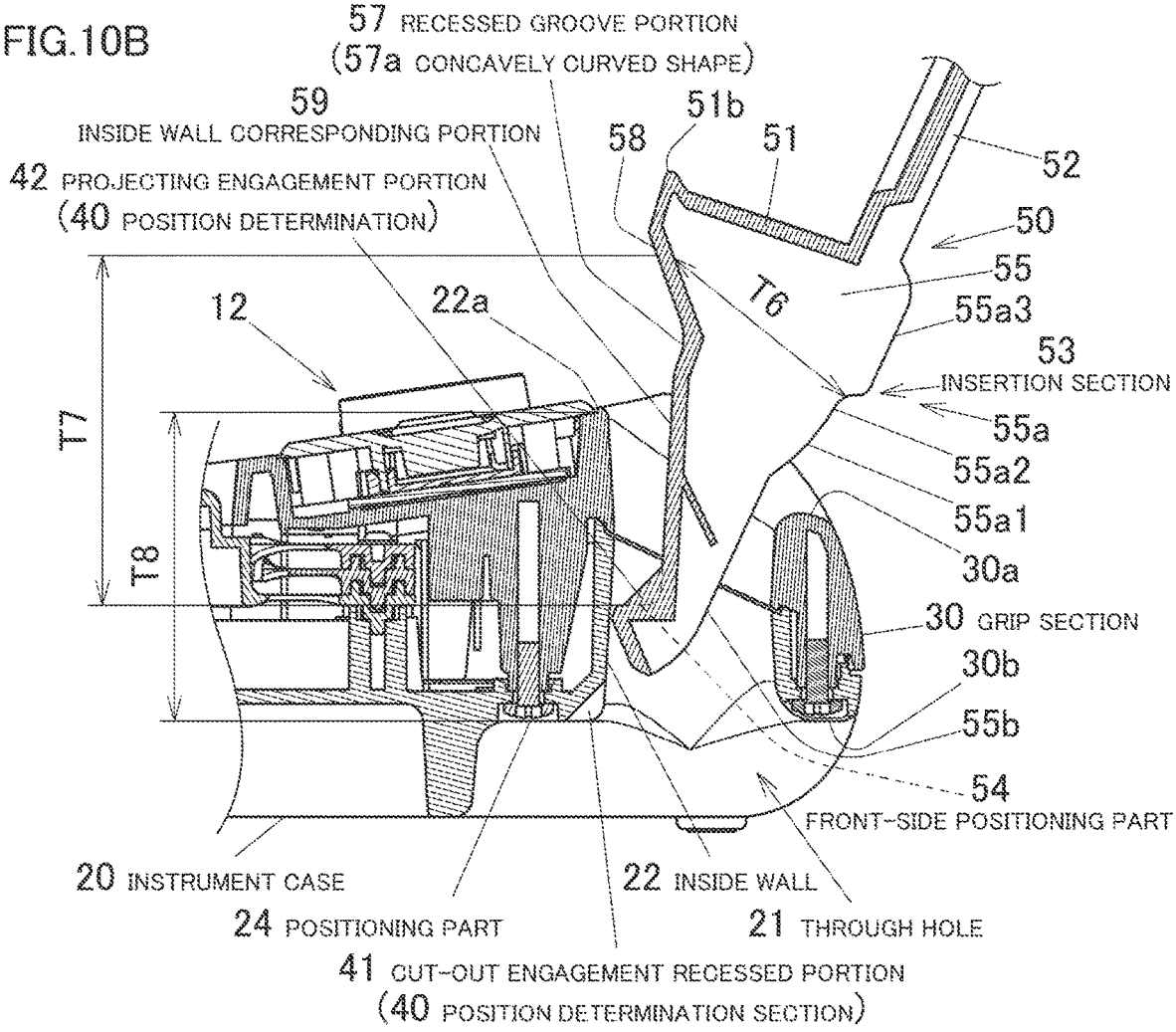
Figure 13:
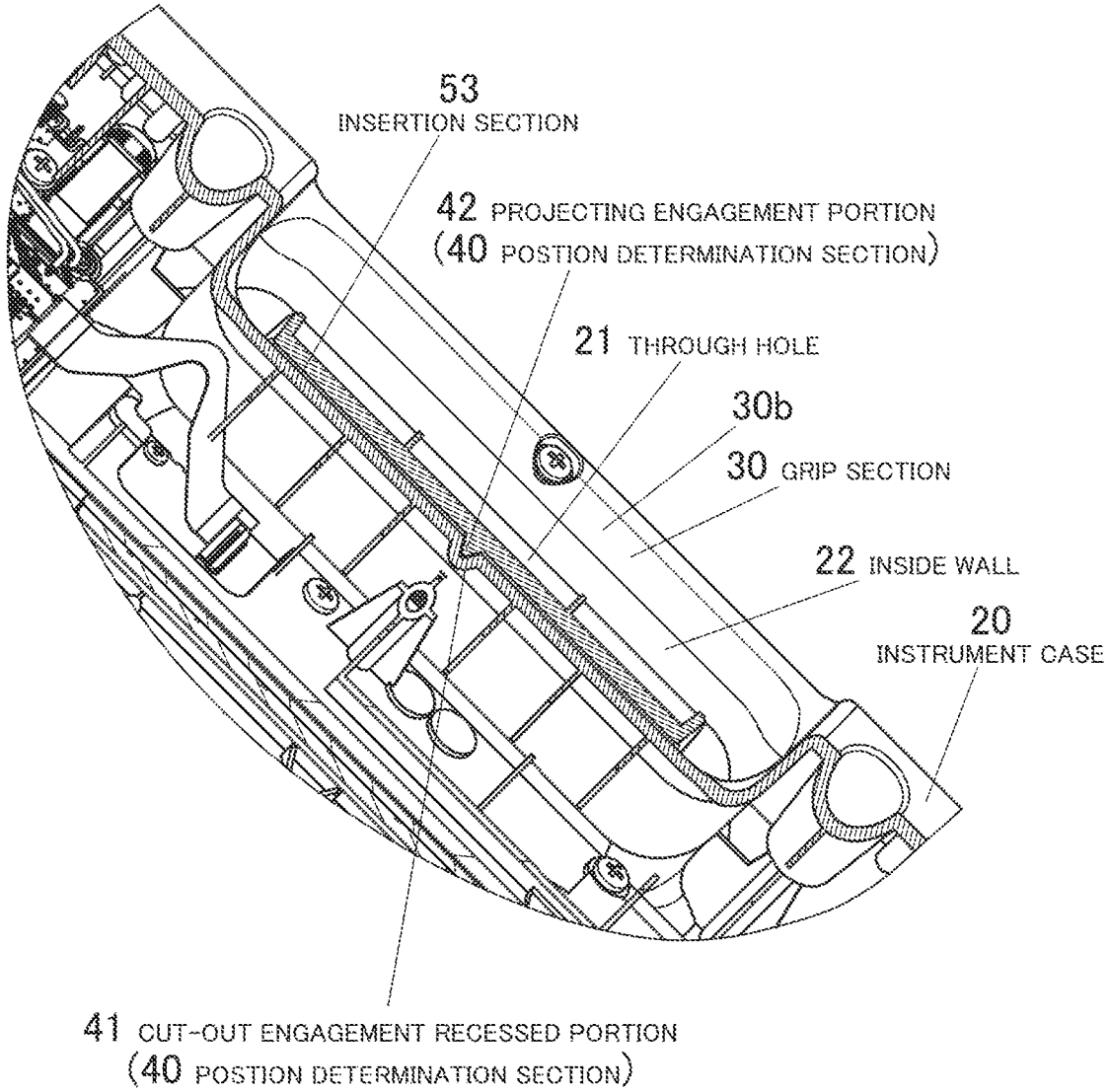
FIG. 13 is a sectional view, taken along a line XIII-XIII in FIG. 11A, which shows a state in which the music stand is attached to the keyboard instrument according to the embodiment of the present invention.

Next, attaching and detaching operations of the music stand 50 will be described. To attach the music stand 50 to the keyboard instrument 10 (the instrument case 20), a distal end portion of the insertion section 53 of the music stand 50 is inserted, as shown in FIG. 10B, from above the through hole 21 into the through hole 21 in the instrument case 20 to which the music stand 50 is not attached as shown in FIG. 10A. As this occurs, both the left and right end portions (ribs 55 at the left and right end portions) of the insertion section 53, which has the tapered shape as seen from the front, are brought into sliding contact with the guide sections 23, whereby the insertion section 53 (the music stand 50) is centered in the left-right direction. Consequently, as shown in FIGS. 11A and 13, the engagement recessed portion 41 and the engagement projecting portion 42 are brought into mating engagement with each other at the position determination section 40.

As another embodiment, the engagement projecting portion 42 may be provided on the instrument case 20, while the engagement recessed portion 41 may be provided on the music stand 50. The position determination section 40, which is configured to determine the positional relationship between the instrument case 20 and the music stand 50, only needs to exist at least either of the instrument case 20 and the music stand 50.

Additionally, although it will be described in detail later on, depending upon the degree at which the music stand 50 is tilted in the front-rear direction, there may be a case in which the edge 22*a* and the inclined portion 58, as well as the upper surface portion 30*a* of the grip section 30 and the projecting arc-shaped edge portion 55*a*1 are brought into sliding contact with each other, whereby the insertion section 53 is guided in the front-rear direction in an interior of the through hole 21. In this way, as shown in FIG. 11B, the positioning part 24 and the front-side positioning part 54 are decided on a position together. Then, as shown in FIGS. 11A, 11B, the upper surface portion 30*a* of the grip section 30 and the rear-side positioning part 55*a* (the recessed arc-shaped edge portion 55*a*2) are decided on a position together. Consequently, the user can attach the music stand 50 to the keyboard instrument 10 or the instrument case 20 without having to position them accurately only by inserting the insertion section 53 into the through hole 21.

Figure 12A:
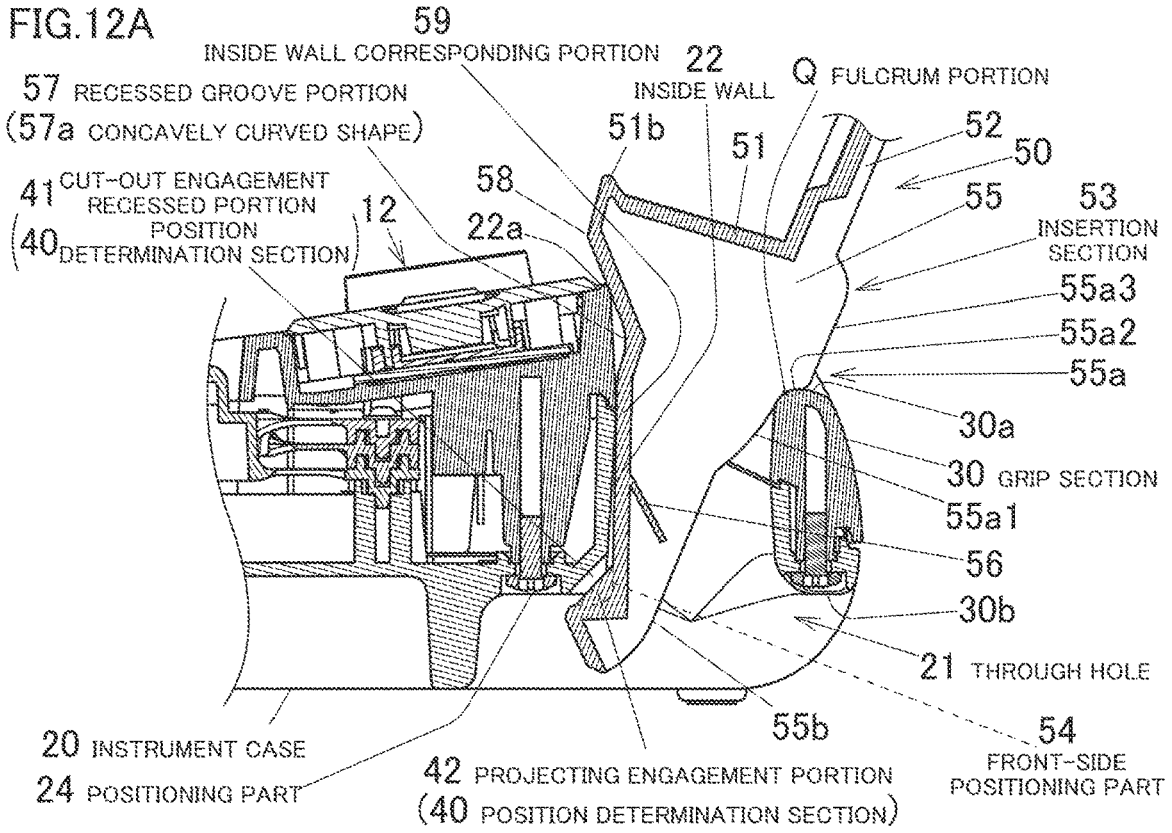

In addition, in the steady state shown in FIGS. 11A, 11B, the gap G is defined between the inclined portion 58 of the insertion section 53 and the top surface 20*a* side of the edge 22*a* of the through hole 21. Then, to detach the music stand 50 from the keyboard instrument 10 or the instrument case 20, as shown in FIG. 12A, the music stand 50 is tilted one gap G around the fulcrum portion Q to the front. Then, the inclined portion 58 of the insertion section 53 and the top surface 20*a* side of the edge 22*a* of the through hole 21 are brought into abutment with each other. Thereafter, when the music stand 50 is pulled out upwards, the edge 22*a* slides and moves relatively from the inclined portion 58 to the recessed groove portion 57 while following the inclined portion 58. At the same time, the upper surface portion 30*a* of the grip section 30, which is then in abutment with the recessed arc-shaped edge portion 55*a*2 at the fulcrum portion Q, slides and moves relatively along the projecting arc-shaped edge portion 55*a*1 while following it That is, since the projecting arc-shaped edge portion 55*a*1 is disposed on the rib 55 provided on the rear side of the recessed groove portion 57, the positioning part 24 and the front-side positioning part 54 (and the front-side inside wall 22 and the inside wall corresponding portion 59) can gradually be separated from each other without the user being aware of it when the sliding movement occurs between the recessed groove portion 57 and the edge 22*a*, as well as the projecting arc-shaped edge portion 55*a*1 and the upper surface portion 30*a*.

The sliding movement also occurs between the edge 22*a* and the recessed groove portion 57 and between the upper surface portion 30*a* and the projecting arc-shaped edge portion 55*a*1 when the music stand 50 is attached to the keyboard instrument 10 or the instrument case 20. In this case, the positioning part 24 and the front-side positioning part 54 (and the front-side inside wall 22 and the inside wall corresponding portion 59) are caused to move gradually towards each other.

Figure 12B:
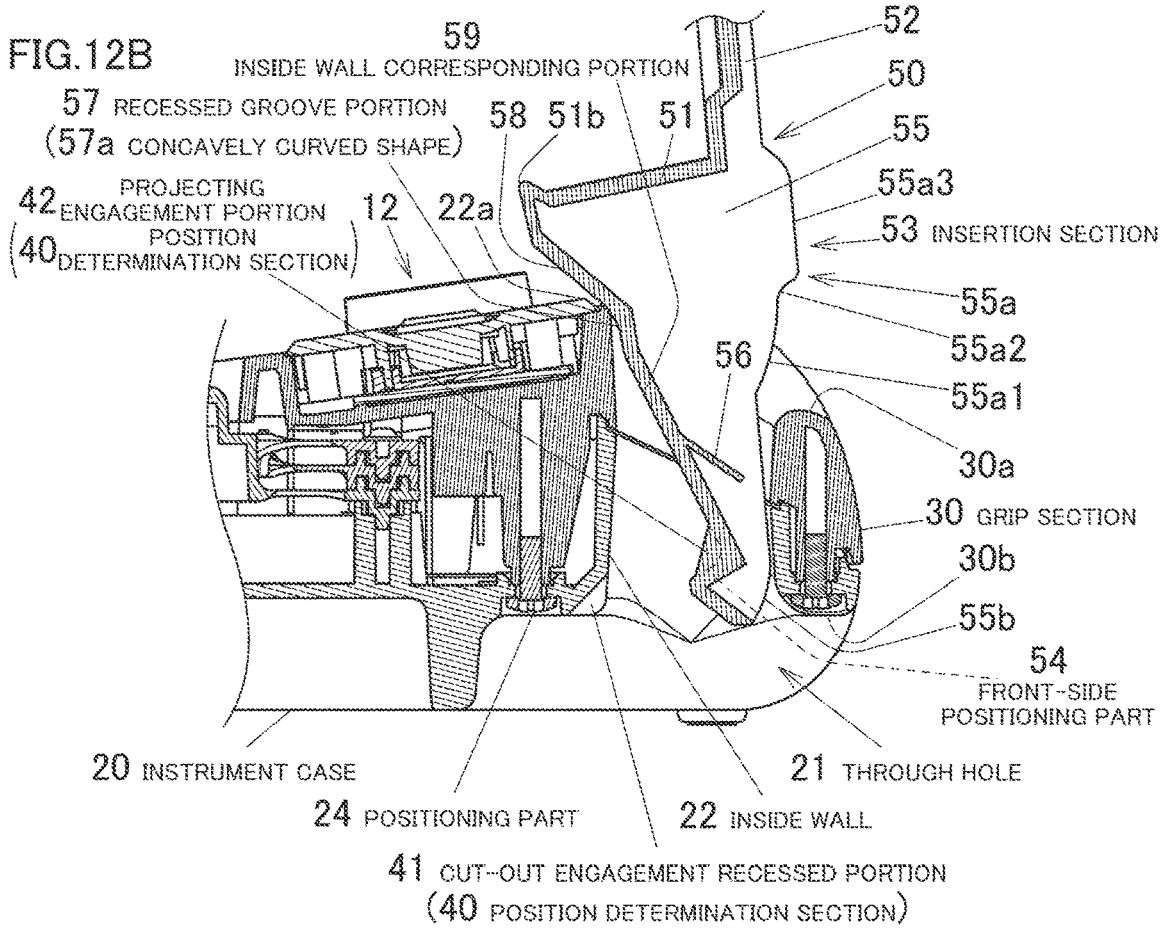

In this way, as shown in FIG. 12B, the locking between the front-side positioning part 54 and the positioning part 24 and the mating engagement between the engagement projecting portion 42 and the engagement recessed portion 41 at the position determination section 40 are released. Consequently, the user can easily detach the music stand 50 from the keyboard instrument 10 or the instrument case 20 without involvement of any specific operation only by tilting the music stand 50 slightly to the front side F and then pulling it out from the through hole 21.

Thus, as has been described heretofore, with the embodiments of the present invention, the keyboard instrument 10 includes the keyboard 11 and the instrument case 20, and the instrument case 20 includes the through hole 21 that penetrates the instrument case 20 from the top surface 20*a* side to the bottom surface 20*b* side and the positioning part 24 configured to decide on a position of the music stand 50 when the insertion section 53, which is the part of the music stand 50, is inserted into the through hole 21. As a result, since the music stand 50 can be decided on a position of the instrument case 20 only by inserting the insertion section 53 of the music stand 50 into the through hole 21, there can be provided the keyboard instrument 10 in which the music stand 50 can easily be attached to the instrument case 20 without any looseness.

In addition, the instrument case 20 includes the grip section 30, which is provided at the central portion of the aligning direction LR of the keys and on the rear side B of the leys in the front-rear direction FB, and the grip section 30 includes the inside wall 22 of the through hole 21 on the rear side B thereof, which constitutes the part of the inside wall 22 of the through hole 21. As a result, it becomes easy to move or carry the keyboard instrument 10, as well as to play the keyboard instrument 10 while holding it by gripping the grip section 30.

The positioning part 24 has the position determination section 40 configured to determine the position where to lock the music stand. As a result, the music stand 50 can be positioned in an ensured fashion.

In addition, the position determination section 40 includes the engagement recessed portion 41 and includes the engagement projecting portion 42 on the music stand 50 in the position corresponding to the position determination section 40. As a result, the music instrument 50 can easily be positioned without any looseness by bringing the engagement recessed portion 41 and the engagement projecting portion 42, which are both configured simply, into mating engagement with each other.

The instrument case 20 has the guide sections 23 provided in such a manner as to be curved so as to guide the music stand 50 to the position determination section 40 on the circumference of the through hole 21 on the top surface 20*a* side of the instrument case 20. As a result, since the music stand 50 is guided to the predetermined locking position without the awareness of the user, the music stand 50 can easily be attached to the instrument case 20.

The keyboard instrument 10 includes the fulcrum portion Q on the top surface 20*a* side of the grip section 30, which functions as the fulcrum when the insertion section 53, which constitutes the part of the music stand 50, is disposed in the through hole 21 whereby the music stand 50 is decided on a position of the instrument case 20. As a result, the setting and releasing of the deciding on a position between the positioning part 24 and the front-side positioning part 54 and the abutment between the front-side inside wall 22 and the inside wall corresponding portion 59 can be performed without the awareness of the user when the music stand 50 is attached to and detached from the instrument case 20.

Additionally, the positioning part 24 includes the application point portion P that resists the force in the second direction S2 that is generated against the force in the first direction S1 that is generated as a result of the musical score is placed to lean against the music stand 50 in such a state that the part of the music stand 50 is disposed in the through hole 21. As a result, when the musical score is placed to lean against the music stand 50, the music stand 50 can be decided on a position in a more ensured fashion by the positioning part 24.

In the instrument case 20, the keyboard 11 side inside wall 22 of the through hole 21 and the positioning part 24 are disposed substantially perpendicularly (the reference sign PE) to each other, the music stand 50 has the insertion section 53 that projects from the central lower end 50*a*, and the insertion section 53 includes the inside wall corresponding portion 59 and the front-side positioning part 54 which are both disposed substantially at right angles to the keyboard 11 side inside wall 22 and the positioning part 24, respectively. As a result, the music stand 50 can be decided on a position of the instrument case 20 in a more ensured fashion by the deciding on a position of the front-side positioning part 54 and the positioning part 24 and the abutment of the keyboard 11 side inside wall 22 and the inside wall corresponding portion 59.

The insertion section 53, which projects from the central lower end of the music stand 50, includes the recessed groove portion 57, which is formed in the left-right direction while being concavely curved at the bottom portion, on the front surface side thereof in the position lying further upwards than the front-side positioning part 54. As a result, the music stand 50 can easily be detached from the instrument case 20 using the recessed groove portion 57.

While the several embodiments of the invention have been described heretofore, these embodiments are presented as the examples, and hence, there is no intention that the scope of the invention is limited by the embodiments. These novel embodiments can be carried out in other various forms, and various omissions, replacements, alterations and modifications can be made thereto without departing from the spirit and scope of the invention. The resulting embodiments and modifications thereof are incorporated in the spirit and scope of the present invention and are also incorporated in the scope of inventions claimed herein and their equivalents.

What is claimed is:

1. A keyboard instrument comprising:

a keyboard; and an instrument case having a through hole which penetrates through the instrument case from a top surface side to a bottom surface side thereof, and a positioning part configured to determine a position of a music stand when a part of the music stand is disposed in the through hole.

2. The keyboard instrument according to claim 1, wherein the instrument case comprises a grip section provided at a central portion thereof along an aligning direction of keys of the keyboard and at a rear side of the keys in a front-rear direction of the keyboard, and wherein the grip section comprises a part of an inside wall of the through hole.

3. The keyboard instrument according to claim 2, comprising:

a fulcrum portion provided on a top surface side of the grip section to function as a fulcrum when the part of the music stand is disposed in the through hole, so that the position of the music stand with respect to the instrument case is determined.

4. The keyboard instrument according to claim 1, wherein the positioning part has a position determination section configured to determine a position at which to lock the music stand.

5. The keyboard instrument according to claim 2, wherein the positioning part has a position determination section configured to determine a position at which to lock the music stand.

6. The keyboard instrument according to claim 3, wherein the positioning part has a position determination section configured to determine a position at which to lock the music stand.

7. The keyboard instrument according to claim 4, wherein the position determination section comprises an engagement recessed portion engagable with an engagement projecting portion provided on the music stand at a position corresponding to the position determination section.

8. The keyboard instrument according to claim 5, wherein the position determination section comprises an engagement recessed portion engagable with an engagement projecting portion provided on the music stand at a position corresponding to the position determination section.

9. The keyboard instrument according to claim 6, wherein the position determination section comprises an engagement recessed portion engageable with an engagement projecting portion provided on the music stand at a position corresponding to the position determination section.

10. The keyboard instrument according to claim 4, comprising:

a guide section provided on a circumference of the through hole on the top surface side of the instrument case and configured to guide the music stand to the position determination section.

11. The keyboard instrument according to claim 5, comprising:

a guide section provided on a circumference of the through hole on the top surface side of the instrument case and configured to guide the music stand to the position determination section.

12. The keyboard instrument according to claim 6, comprising:

a guide section provided on a circumference of the through hole on the top surface side of the instrument case and configured to guide the music stand to the position determination section.

13. The keyboard instrument according to claim 7, comprising:

a guide section provided on a circumference of the through hole on the top surface side of the instrument case and configured to guide the music stand to the position determination section.

14. The keyboard instrument according to claim 8, comprising:

a guide section provided on a circumference of the through hole on the top surface side of the instrument case and configured to guide the music stand to the position determination section.

15. The keyboard instrument according to claim 9, comprising:

a guide section provided on a circumference of the through hole on the top surface side of the instrument case and configured to guide the music stand to the position determination section.

16. The keyboard instrument according to claim 1, wherein the positioning part comprises an application point portion configured to resist a force in a second direction which is generated against a force in a first direction which is generated as a result of a musical score being placed to lean against the music stand in a state in which the part of the music stand is disposed in the through hole.

17. The keyboard instrument according to claim 2, wherein the positioning part comprises an application point portion configured to resist a force in a second direction which is generated against a force in a first direction which is generated as a result of a musical score being placed to lean against the music stand in a state in which the part of the music stand is disposed in the through hole.

18. The keyboard instrument according to claim 1, wherein in the instrument case, a keyboard side inside wall of the through hole and the positioning part are disposed substantially at right angles to each other, and wherein the music stand has an insertion section projecting from a central lower end thereof, and the insertion section comprises an inside wall corresponding portion and a front-side positioning part which are both disposed substantially at right angles to the keyboard side inside wall and the positioning part, respectively.

19. The keyboard instrument according to claim 2, wherein in the instrument case, a keyboard side inside wall of the through hole and the positioning part are disposed substantially at right angles to each other, and wherein the music stand has an insertion section projecting from a central lower end thereof, and the insertion section comprises an inside wall corresponding portion and a front-side positioning part which are both disposed substantially at right angles to the keyboard side inside wall and the positioning part, respectively.

20. The keyboard instrument according to claim 18, wherein the insertion section projecting from the central lower end of the music stand has a recessed groove portion, which extends in an aligning direction of keys of the keyboard while being concavely curved at a bottom portion thereof, provided on a front surface side of the insertion section a position further upwards than the front-side positioning part.

* * * * *